US006595323B2

(12) United States Patent
Lindsey et al.

(10) Patent No.: US 6,595,323 B2
(45) Date of Patent: Jul. 22, 2003

(54) POLE STEP AND ATTACHMENT MOUNT FOR POLES

(75) Inventors: Keith E. Lindsey, La Canada, CA (US); Steven D. Scholfield, Glendora, CA (US)

(73) Assignee: Lindsey Manufacturing Company, Azusa, CA (US)

( * ) Notice: Subject to any disclaimer, the term of this patent is extended or adjusted under 35 U.S.C. 154(b) by 0 days.

(21) Appl. No.: 09/982,674

(22) Filed: Oct. 18, 2001

(65) Prior Publication Data

US 2002/0066620 A1 Jun. 6, 2002

Related U.S. Application Data

(62) Division of application No. 09/277,384, filed on Mar. 25, 1999, now abandoned.
(60) Provisional application No. 60/101,671, filed on Sep. 24, 1998, and provisional application No. 60/079,240, filed on Mar. 25, 1998.

(51) Int. Cl.[7] ..... E06C 9/00
(52) U.S. Cl. ..... 182/92
(58) Field of Search ..... 411/34, 38; 248/218.4, 248/231.91, 220.31, 220.41; 182/92, 189, 100

(56) References Cited

U.S. PATENT DOCUMENTS

| | | | | |
|---|---|---|---|---|
| 666,947 A | | 1/1901 | Ward | |
| 829,336 A | * | 8/1906 | Haycock | |
| 1,003,662 A | | 9/1911 | Sharp | |
| 1,211,992 A | | 1/1917 | Winter | |
| 2,640,672 A | | 6/1953 | Bedford, Jr. | 248/239 |
| 2,943,835 A | | 7/1960 | Tierney | 248/216 |
| 2,996,192 A | | 8/1961 | Dell et al. | 211/49 |
| 3,399,746 A | | 9/1968 | Wood | 182/92 |
| 3,911,782 A | * | 10/1975 | Liebig | |
| 4,144,796 A | * | 3/1979 | Richter et al. | |
| 4,319,531 A | | 3/1982 | Caldwell | 108/152 |
| 4,828,439 A | * | 5/1989 | Giannuzzi | |
| 4,936,565 A | | 6/1990 | Fredrickson | 211/59.1 |
| 5,118,235 A | | 6/1992 | Dill | 411/368 |
| 5,378,097 A | * | 1/1995 | Barnavol | |
| 5,941,485 A | * | 8/1999 | Davidson et al. | |

* cited by examiner

*Primary Examiner*—Alvin Chin-Shue
(74) *Attorney, Agent, or Firm*—Christie, Parker & Hale, LLP

(57) ABSTRACT

An apparatus providing a permanent pole step and/or attachment mount for removable steps, accessories or equipment for hollow poles that is practical and economical to use, and that provides a substantially horizontal step or mounting surface that does not rotate and that extends only a limited distance from the hollow pole.

A pole step having a support member and a mating plate, where a portion of the support member is inserted into a mounting hole of the pole and the remaining portion of the support member protrudes out of the hole to create a stepping surface. The plate has a tongue which mates with the support member in the mounting hole to secure the support member.

An attachment mount for attaching temporary steps, equipment or accessories to a hollow pole, having a support member, a mating plate and a guide washer. The plate receives the support member, and the tongue which mates with the support member in the mounting hole to secure it in place. A gap between the guide washer and the plate provides an attachment point for temporary steps, equipment or other accessories.

An attachment mount for attaching temporary steps, equipment or accessories to a hollow pole, having a support member, a plate, and a collapsing cage, where the cage is inserted into the mounting hole and collapsed to form a truss inside the pole.

27 Claims, 10 Drawing Sheets

B
B
A
A
22
24
26
27
28
29
20
SECTION B-B
SECTION A-A

POLE STEP AND ATTACHMENT MOUNT FOR POLES

CROSS REFERENCE TO RELATED APPLICATIONS

This application is a divisional application of U.S. patent application Ser. No. 09/277,384, filed Mar. 25, 1999, now abandoned, which is related to and claims priority from provisional applications No. 60/079,240, filed on Mar. 25, 1998 and No. 60/101,671, filed on Sep. 24, 1998, the contents of both which are hereby incorporated by reference.

FIELD OF THE INVENTION

This invention relates to poles for holding wires and cables, such as telephone, cable television, power or other types of lines in the air and, more particularly, to devices to aid in the climbing of such poles, including pole steps that are permanently mounted to poles, and step mounts that are mounted to poles which provide attachment points for temporary steps, accessories or other equipment.

BACKGROUND OF THE INVENTION

Various types of poles, such as wooden, steel, concrete or fiberglass poles have been used in the past for holding overhead lines. In order to climb these poles, spiked climbing boots are used. However, frequent climbing of the poles in this manner cause damage to the poles. Steps are therefore often installed for poles that may require frequent climbing, eliminating the need to use spiked climbing boots. While permanent steps are often attached to poles, there are some instances where such steps are not desirable. Permanently installed steps that extend to the bottom of the pole may create the problem of unauthorized pole climbing. To address this problem, temporary pole steps are sometimes used for approximately the first ten (10) feet of pole height. These temporary steps are typically carried by the person climbing the pole and are installed on mounts which are permanently attached to the pole.

The most common permanent step design is a ⅝ inch diameter steel bolt, 9–10 inches long, with a coarse lag screw thread on one end, and a turned up foot guard on the other end. The step is hammered or screwed 3–4 inches into the wooden pole, leaving approximately 6 inches protruding from the face of the pole, with the foot guard pointing upwards.

There are a number of other permanent step bolt designs for use with other types of poles and towers. For instance, a common practice in providing for easy climbing on steel lattice towers is to drill a hole in the main steel angle and install a ⅝ inch diameter bolt with two nuts and a lockwasher. The nuts and lockwasher securely fasten the bolt to the steel angle of the structure leg. A common practice with steel poles, on the other hand, is to weld a nut to the outer surface of the pole and then screw the step bolt into the nut. Another method is to weld a special bracket to the steel pole which allows attachment of climbing ladders. In the case of a concrete pole, threaded inserts for pole steps are cast into the pole at the time of fabrication. One method that can be used with wood, steel or concrete poles is to drill a hole through the entire pole and install a bolt, long enough to fit across the entire diameter of the pole. This method, however, is extremely expensive.

Typically, the temporary step mount assembly for a traditional wooden pole consists of a large nail with a specially shaped head. The nail is pounded into the pole leaving the head exposed approximately ½" from the face of the pole. A temporary step may then be slid onto the head of the nail.

With the availability of wooden poles declining, and their cost rising, a newer entrant into the overhead power distribution and communications industry is the hollow fiberglass pole. With a fiberglass pole, none of the traditional permanent or temporary pole steps are practical because they are either not of a suitable design or are too costly. The wall thickness and characteristics of the fiberglass preclude the use of a screwed-in pole step. Use of a step bolt with inner and outer nuts, as is used on lattice towers, is impossible because the inside of the pole is not accessible. Attaching a nut to the surface of a pole, or embedding it in the wall of the pole is not feasible either. Finally, installing a bolt through the entire diameter of the pole may work, but is not an economical solution.

With the increasing use of hollow poles, such as fiberglass, steel or concrete poles, as a replacement for wooden poles, different attachment methods became necessary for mounting permanent pole steps and/or step mounts for temporary steps. The most commonly used method today, for example, for a fiberglass pole, is a ½" diameter "L" shaped bolt that is inserted into a ⅝" diameter hole drilled in the wall of the pole. Once the "L" shaped bolt is inserted into the pole, a backing plate, spacing washer, lockwasher and nut are installed over the protruding leg of the "L" bolt to keep the bolt locked in place. However, as the nut is tightened on the L-shaped bolt, the bolt tends to pull out from the hole, and cause the horizontal leg of the bolt to angle upwards (and consequently, causes the vertical leg to pull away from the inside wall of the pole). Further, the L-shaped bolts may rotate, which is dangerous whether the bolt is itself a step, or the bolt is a mount for a temporary step. Another drawback of this method is that the bolt typically extends approximately 1½" from the backing plate, and unauthorized persons may attempt to climb the pole using these small protrusions as steps. In addition, some localities prohibit the use of a step mount with a protrusion of such size.

It is therefore desirable to have a permanent pole step and an attachment mount design for hollow poles, such as fiberglass, steel and concrete poles, or any pole with a hollow space or cavity inside, that is practical to use, is economical, provides a substantially horizontal step or mounting surface, does not rotate, and is effective in keeping unauthorized persons from climbing the poles.

SUMMARY OF THE INVENTION

The present invention therefore provides an apparatus which aids in the climbing of hollow poles, by providing permanent steps, or by providing attachment points for temporary steps, accessories and other equipment to hollow poles. The invention may be practiced in a variety of embodiments, including permanent steps for attaching to hollow poles, as well as mounts that attach permanently to hollow poles allowing the subsequent attachment of removable temporary steps, or other accessories or equipment. The present invention therefore provides a permanent pole step and/or attachment mount for removable steps, accessories or equipment for hollow poles that is practical and economical to use, and that provides a substantially horizontal step or mounting surface that does not rotate and that extends only a limited distance from the hollow pole.

A first embodiment of the present invention is a permanent step for a hollow pole, comprising essentially of a support member and a mating plate. A portion of the support member is inserted into a mounting hole of the pole and the remaining portion of the support member protrudes out of the hole to create a stepping surface. The plate has a hole which receives the support member, and a tongue which mates with the support member to secure the support member.

A second embodiment of the present invention is an attachment mount for attaching temporary steps, equipment or accessories to a hollow pole, comprised essentially of a support member, a mating plate and a guide washer. A portion of the support member is inserted into a mounting hole of the pole, and the remaining portion protrudes out of the hole. The plate has a hole which receives the support member, and a tongue which mates with the support member to secure it in place. The guide washer substantially abuts the plate, and provides a gap where between the plate and the washer where temporary steps, equipment or other accessories are attached.

A third embodiment of the present invention is an attachment mount for a hollow pole comprising essentially of a support member, a plate, and a collapsing cage. The cage is inserted through a hole in the plate, and the support member is inserted through the plate and into the cage. The assembly is partially inserted into the hollow pole up to the plate, and the cage is collapsed to form a truss against the interior wall of the pole. At the proper torque, the head of the support member shears off, leaving only a small protrusion beyond the plate, with a button-type head for attachment of a temporary step, equipment or other accessories.

DESCRIPTION OF THE DRAWINGS

These and other aspects of the present invention will become more apparent from the following Detailed Description of several presently preferred embodiments of the present invention read in conjunction with the accompanying drawings.

DETAILED DESCRIPTION OF THE INVENTION

The present invention provides a cost effective solution for providing pole steps and attachment mounts on poles having a hollow portion. The preferred embodiments include both permanent pole steps and attachment mounts for mounting temporary steps, equipment or other accessories.

The following description provides specific preferred dimensions and sizes for a particular embodiment of the present invention, adapted for a particular use. It will be appreciated by those skilled in the art that such dimensions and proportions are merely illustrative, and do not limit the invention in any way, and may be readily changed to meet particular needs. Location, pole manufacturer, intended use and other considerations may affect the particular dimensions, measurements and configurations of the particular embodiment, and one skilled in the art will appreciate that such parameters may be varied in practicing this invention.

Figure 1:
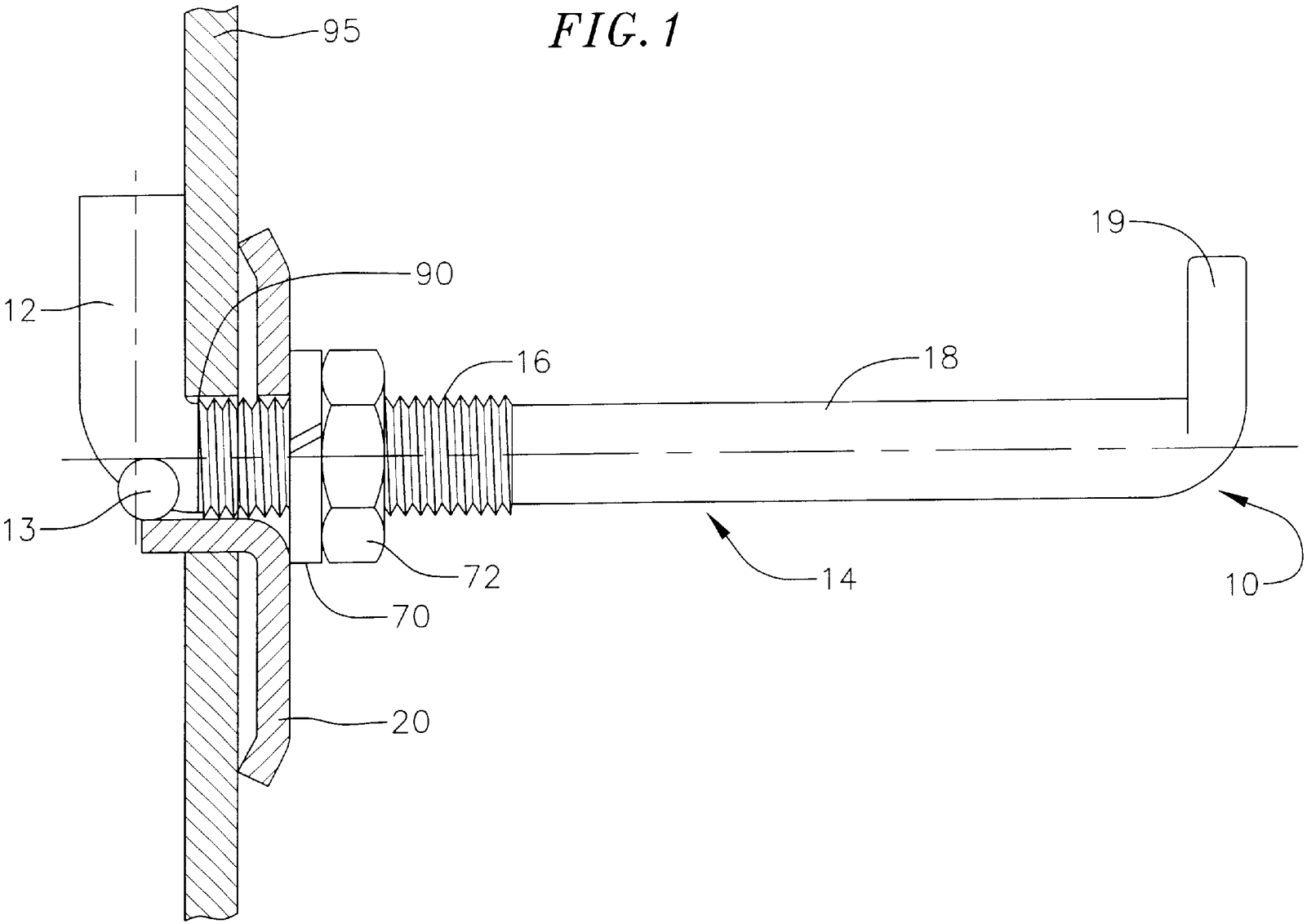
FIG. 1 is a side view of a pole step assembly according to a first embodiment of the present invention.

Referring to FIG. 1, a first embodiment of the present invention is a permanent pole step, including a support member, in this case a bolt 10, in the approximate shape of an "L". It will be appreciated that a variety of other support members could be used, such as rod, a screw, a beam, a channel, or any other support members known in the art. In a preferred embodiment, the bolt is constructed of steel, but could also be constructed on any other rigid, durable material, including metals, composites, plastics or fiber materials. The short vertical first leg 12 of the "L", which is preferably 0.678 inch in diameter, is inserted into a hole 90 in a wall 95 of the pole, with the leg pointing upwards. Preferably, the horizontal, or second leg 14 of the "L" has a ⅝ inch diameter, with a threaded portion 16, preferably the first 2 inches from the short leg, having a ¾ inch 10 thread. The remainder 18 of the leg is preferably unthreaded, and defines the stepping surface. A threaded portion with a step could be used instead. Other support member configurations could also be used, so long as the configuration results in a portion of the support member outside the pole that enables a worker to use the structure to assist in climbing, and a portion of the bolt inside the pole that secures the step to the wall of the pole. Furthermore, in a preferred embodiment, at the end of the stepping surface is a foot guard 19 which points upwards in the same direction as the short leg. Preferably, this foot guard is ⅞ tall. In a preferred embodiment, the bolt also has a horizontal stake 13 along its lower surface, located at the outer radius defined by the intersection of the first and second legs, with the stake substantially perpendicular to both the first and second legs. The foot guard may be provided in a variety of shapes and sizes or may be omitted entirely. The pole step can be formed in one piece as shown, or a plurality of pieces mated together.

Figure 2:
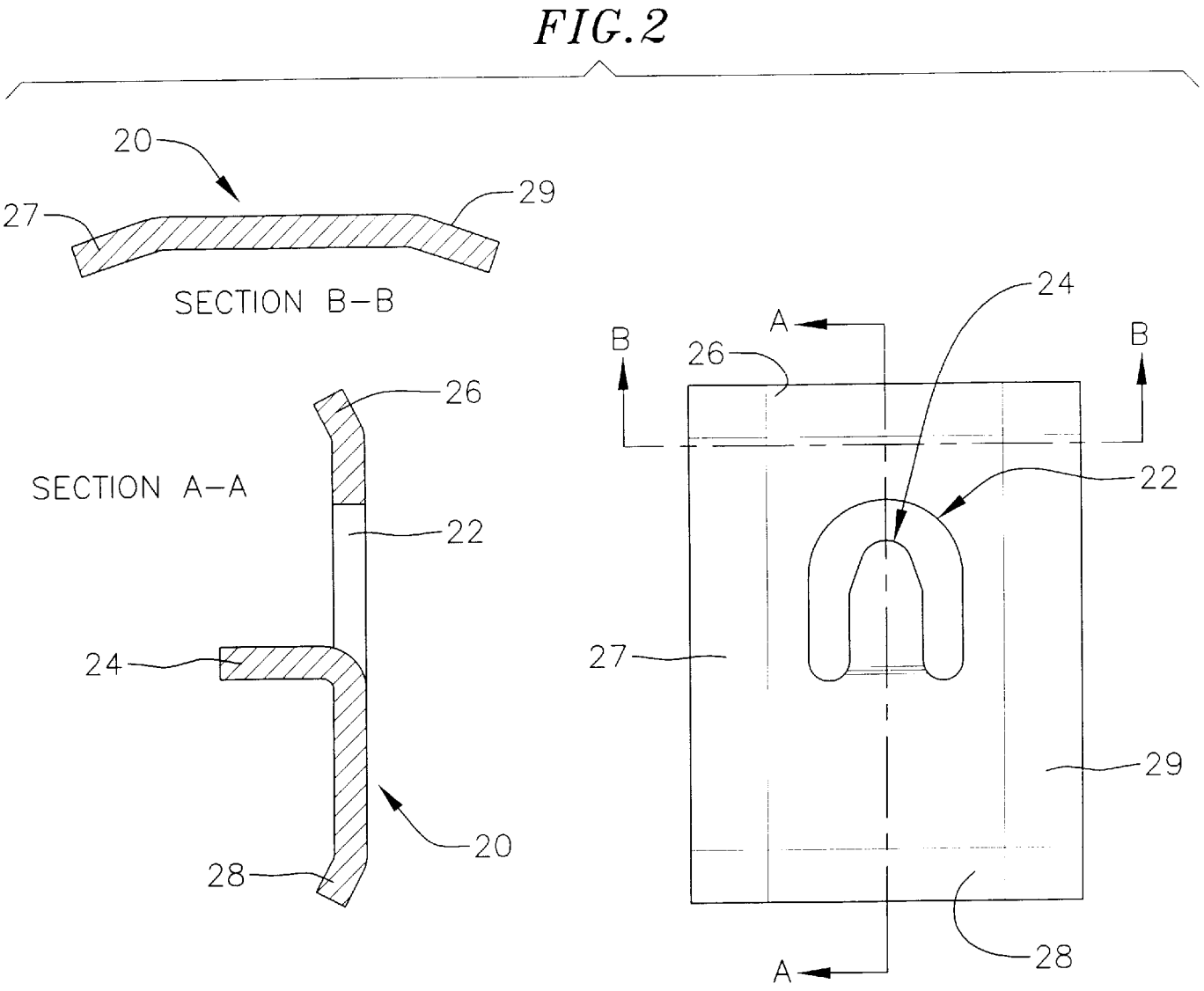
FIG. 2 is a cross-sectional view of a plate according to a first embodiment of the present invention taken along lines A—A and B—B.

Referring to FIG. 2, a specially designed plate 20 mates with the above described bolt to ensure that the step is properly installed and functions correctly. The plate is preferably made of 3/16 inch thick mild steel and is approximately 2.250 inches wide by 2.875 inches tall. A hole 22 is located near the center of the plate, configured for the bolt to pass through. In the preferred embodiment, the hole measures 29/32 inch, and is located on the horizontal centerline of the plate, 1 inch below the top of the plate. The upper portion of this hole is in the shape of a semi-circle, while the lower portion of the hole is squared off and has a tongue 24 that is bent away from the face of the plate, providing a flat surface below the hole. In the preferred embodiment, this flat surface is ¼ inch below the center of the hole. In an embodiment directed to round poles, the upper 26 and lower 28 edges of the plate, preferably 0.25 inches, and the left 27 and right 29 edges of the plate, preferably 0.438 inches, are bent inwardly approximately ⅛ inch, providing a better mating surface to the round pole, and adding stiffness to the plate. However, when used on poles with flat surfaces, such as an octagonal pole, the plate may remain flat.

To install the pole step, a hole 90 is drilled through the wall 95 of the hollow fiberglass pole. Preferably, the hole is approximately 15/16 inch in diameter. The short leg 12 of the "L" bolt is first inserted into the hole. The mating plate 20 is installed next by guiding it over the foot guard 19 and along the horizontal leg 14 of the bolt 10, with the tongue 24 pointing toward the pole and on the lower surface of the bolt. The tongue 24 fills the space in the oversized hole 90 drilled in the pole, mating with the horizontal stake 13 on lower portion of the "L" bolt to provide a snug fit which essentially locks the bolt in place. In a preferred pole step embodiment, a standard ¾ inch split lockwasher 70 and a ¾ inch 10 jam nut 72 are next respectively guided over the foot guard 19 and threaded into position to secure the bolt 10 in place. It will be appreciated that although the preferred embodiment utilizes a bolt and nut, that other threaded members and fasteners could also be used to secure the device, as well as non-threaded members and fasteners, or even fixed fastening methods, such as welding, soldering or melting.

Figure 3:
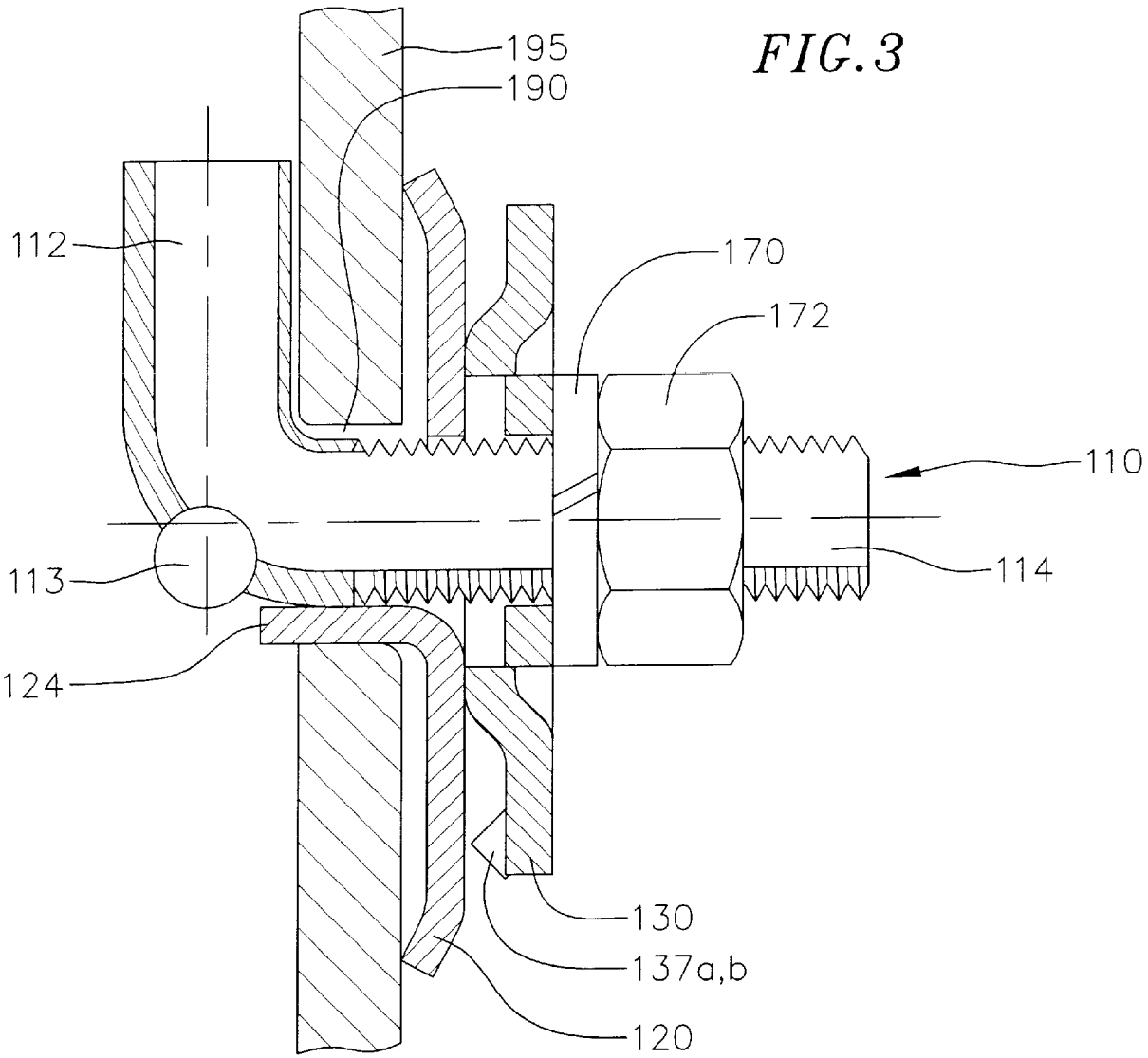
FIG. 3 is a side view of a step mount assembly, showing the bolt, plate, and guide washer, according to a second embodiment of the present invention.
Figure 4:
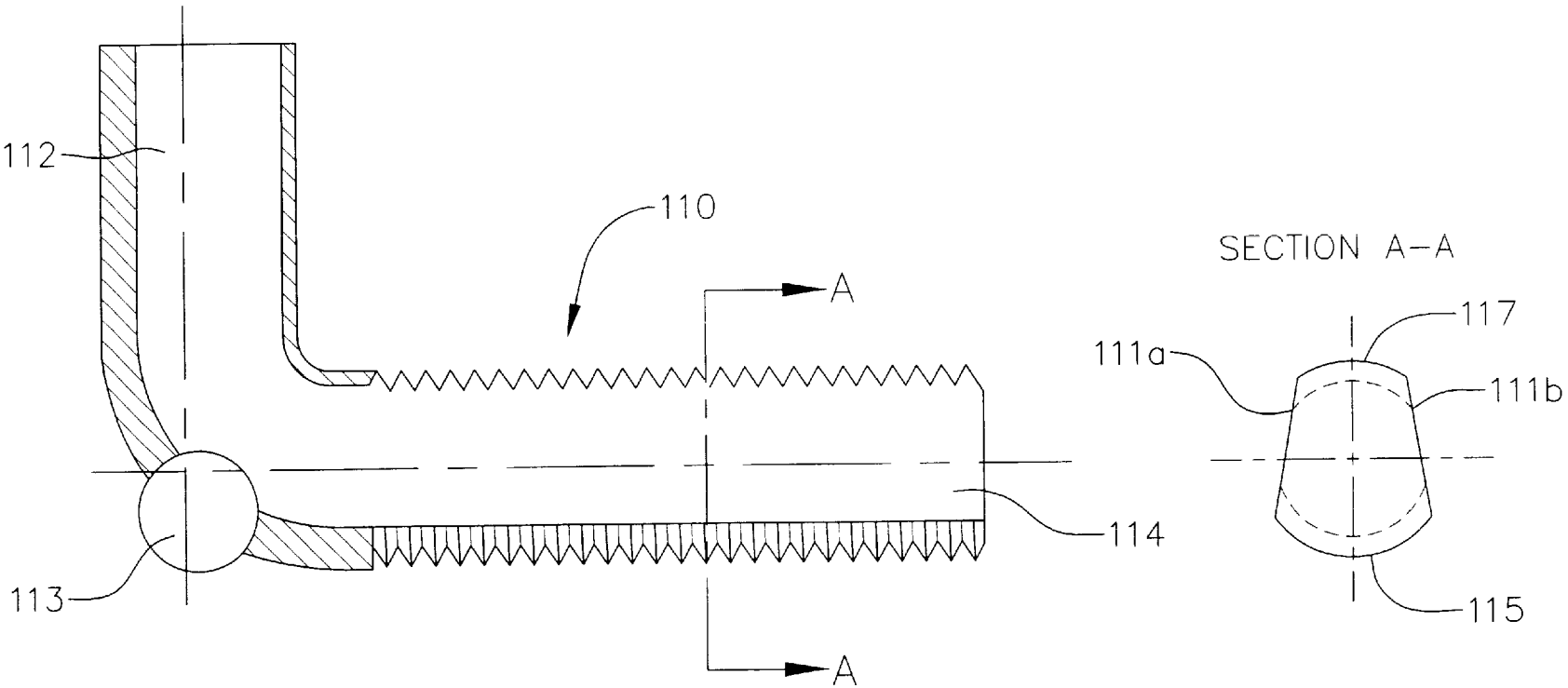
FIG. 4 is a cross-sectional view of the bolt of FIG. 3, taken along lines A—A.

As will become apparent to one skilled in the art, the mating of the "L" bolt 10 with the tongue 24 of the plate 20 prevents the bolt from being pulled back out of the pole as the nut 72 is tightened. Without the mating of the bolt with the plate, the unthreaded stepping surface 18 of the bolt may end up at a 30–45 degree angle to the horizontal, with the vertical leg 12 of the step bolt a corresponding angle away from the inner surface of the wall 95 of the pole. Having the step bolt in this position creates undesirable stress concentrations on the fiberglass pole, and also leaves the step at too steep of an angle for climbing purposes. Also, when the bolt is this angled position, an upward force on the horizontal portion of the bolt would rotate the bolt, removing the bolt from the pole. However, with the locking tongue 24 of the plate 20 described in accordance with the present invention, and the horizontal stake 13 on the lower surface of the bolt, the "L" bolt 10 remains essentially horizontal, with only a slight elevation resulting from the tolerances required during manufacturing and installation. Furthermore, because the locking tongue 24 of the plate becomes slightly embedded into the edges of the mounting hole 90, the step bolt is kept from rotating while the nut 72 is being tightened. Referring to FIG. 3, a second embodiment of the present invention provides a cost effective solution for providing temporary step mounts on fiberglass, or other thin wall poles. These step mounts are mounted permanently to the hollow pole, and temporary steps, or other equipment or accessories, may be attached to the mounts. Structurally, this second embodiment of the present invention is similar to the first embodiment, the permanent pole step described above. Again, it will be appreciated that although the preferred embodiment utilizes a bolt for a support member, and a nut as a fastener, a nail, rod, beam, channel or other rigid member known in the art could be used as a support member, and the fastener could be either threaded or non-threaded, or even a fixed fastening method such as welding. The second embodiment of the present invention uses a bolt 110 in the approximate shape of an "L" as a support member. Other configurations could also be used, so long as the configuration results in a portion of the support member outside the pole, and a portion of the support member inside the pole that is substantially parallel to and abutting the inner wall of the pole. The vertical leg 112 of the "L", which is preferably approximately 9/16 inch in diameter, is inserted into a hole 190 in the wall 195 of the fiberglass pole, with the vertical leg 112 pointing upwards. The horizontal leg 114 of the "L" is preferably ⅝ inch in diameter, extending 2 7/16 inches from the centerline of the vertical leg and having a ⅝ inch 11 thread. Referring to FIG. 4, the threaded portion of the bolt is substantially trapezoidal in cross section, with planar sides 111*a,* 111*b,* each angled inward from vertical, preferably 10°. Thus the lower portion of the bolt defines a threaded arc 115, preferably approximately 0.5 inches horizontally between the endpoints of the arc, and the upper portion of the bolt defines a second threaded arc 117, preferably approximately 0.400 inches horizontally between the endpoints of the arc, with the angled planar sides disposed therebetween the two threaded arcs. In the preferred embodiment, the L-shaped bolt also has a horizontal stake 113 along its lower surface, located at the outer radius defined by the intersection of the horizontal 114 and vertical 112 legs, with the stake 113 substantially perpendicular to both legs.

Figure 5:
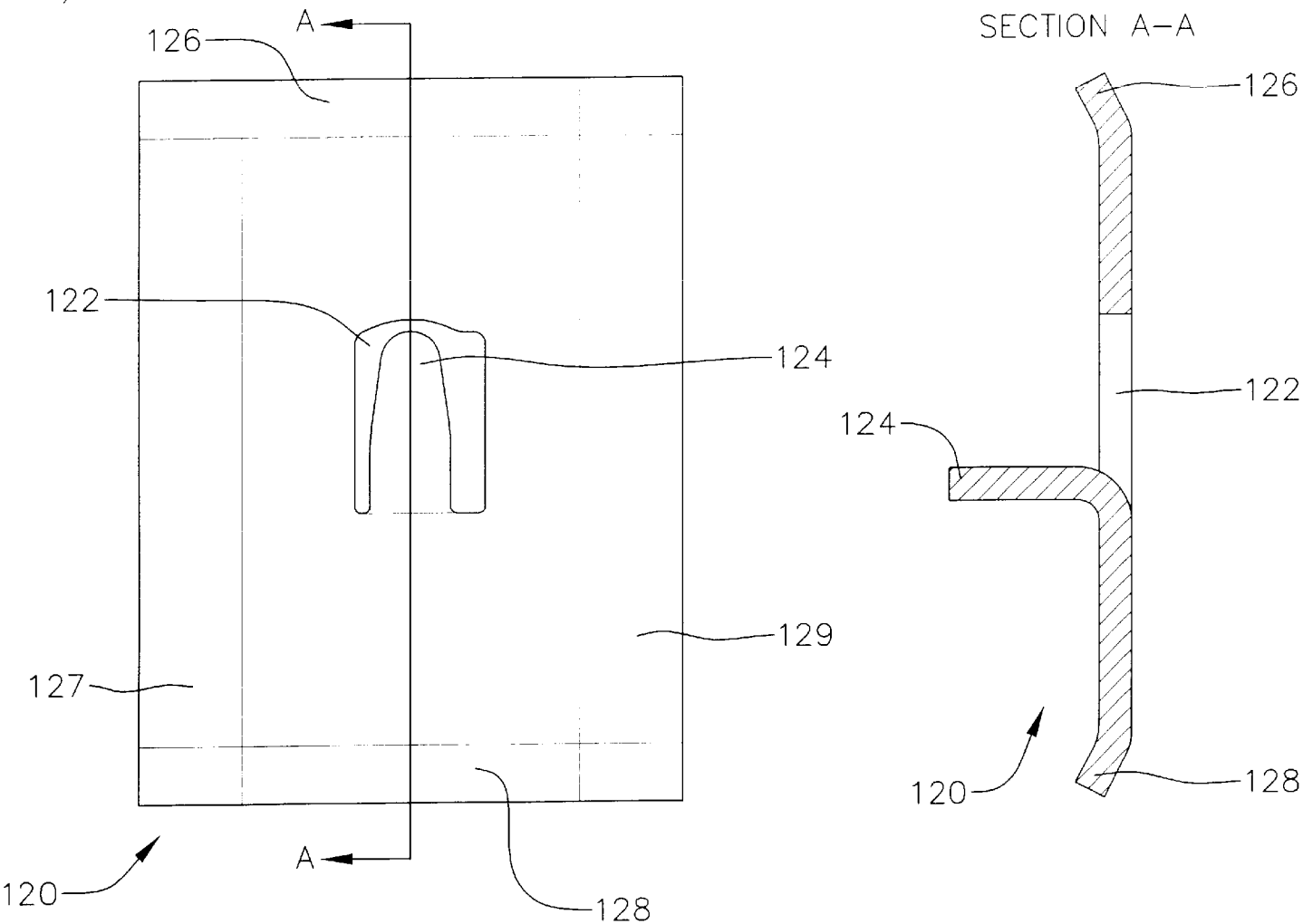
FIG. 5 is a front elevation view of the plate of FIG. 3.
Figure 6:
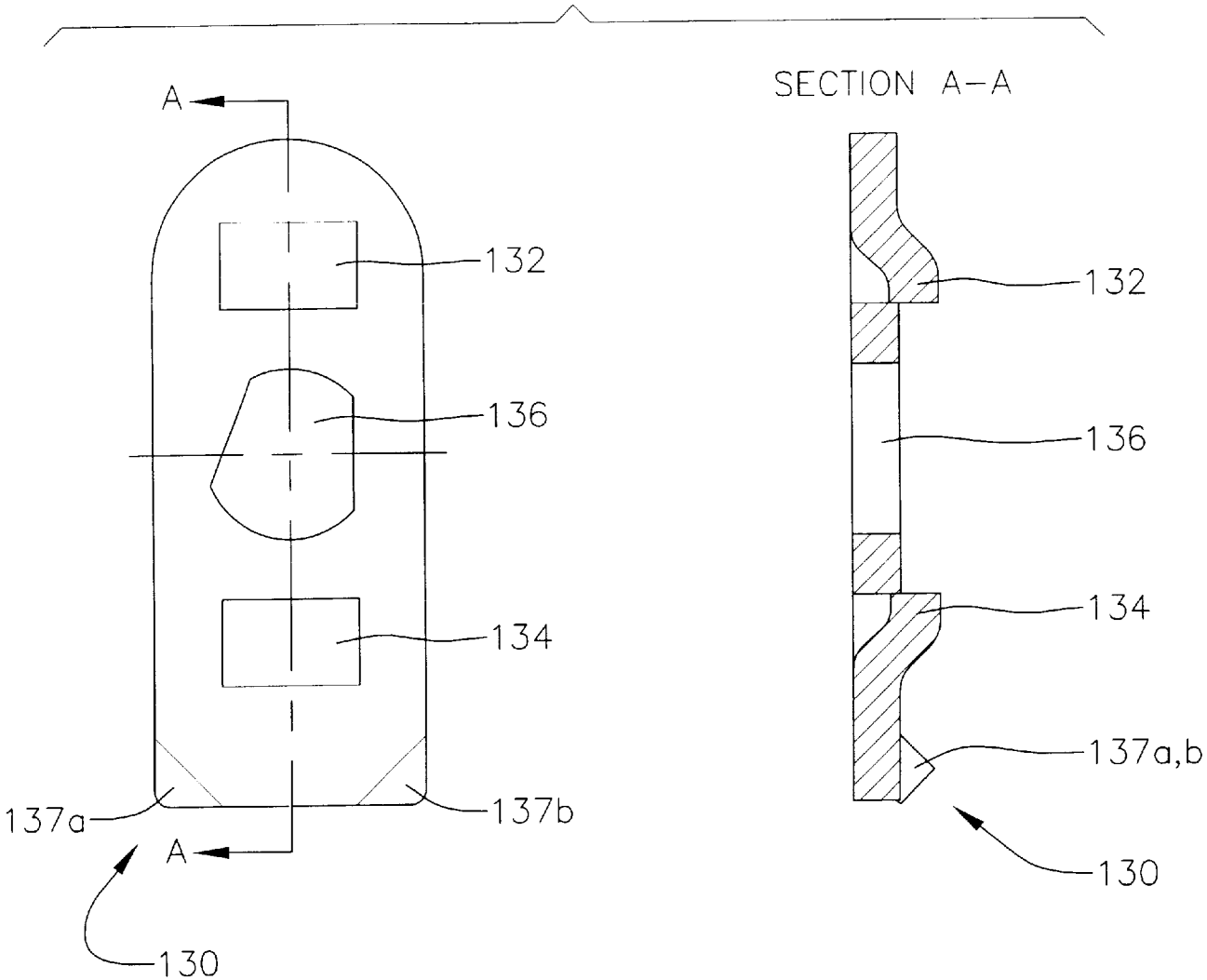
FIG. 6 is a front elevation view of the guide washer of FIG. 3.

Referring to FIG. 5, a specially designed plate 120 mates with the above described bolt 110 to ensure that the bolt is properly installed and functions correctly, and to prevent rotation of the bolt. Preferably, the plate is made of ⅛ inch thick mild steel and is approximately 2.250 inches wide by 2.875 inches tall. A hole 122 is located near the center of the plate, preferably a ¼ inch hole located on the horizontal centerline, 1 inch below the top of the plate. This hole is preferably in the shape of a semi-circle at the top, with the lower half of the hole squared off and having a tongue 124 that is bent away from the face of the plate, providing a flat surface below the hole. Preferably, the flat surface of the tongue 124 is ¼ inch below the center of the hole. In an embodiment direct to round poles, the upper 126 and lower 128 edges of the plate, preferably approximately 0.25 inch, and the left 127 and right 129 edges, preferably approximately 0.438 (7/16) inch, are bent inwardly approximately ⅛ inch, providing a better mating surface to the round pole and stiffening the plate. When used with non-round poles, such as octagonal poles which provide a flat mounting surface, the plate remains flat.

A guide washer 130 mates with the above described plate 120 to define a gap between the plate 120 and the guide washer 130, which is configured to receive a standard temporary pole step. The washer 130 is substantially rectangular in shape, with the upper end semicircular in shape while the lower end is substantially square in shape. The washer has two tabs 132, 134 which extend outward toward the plate, to provide a gap between the plate and the washer. This gap is adapted to receive a conventional temporary step, or to hold equipment or accessories. The washer further has a central opening 136 of substantially trapezoidal shape, and slightly larger than the cross-section of the bolt 110, to allow the bolt to pass through, with the side walls of the opening aligned with the planar side walls 111*a,* 111*b* of the bolt.

The lower corners 137*a,* 137*b* of the washer are bent in, preferably at a 45° angle, in the same direction as the tabs, to block access to the gap area between the plate and the washer. This prevents installation of temporary steps in the wrong gap, in the event the washer is installed incorrectly, such as upside down, as the gap is now only accessible from the upper end of the washer.

To install the step mount, a hole 190 is drilled in the wall 195 of the fiberglass pole, preferably approximately ¾ inch in diameter. The vertical leg 112 of the "L" bolt 110 is first inserted into the hole, with the vertical portion 112 pointing upwards. The mating plate 120 is installed next by guiding it along the bolt 110, with the tongue 124 pointing toward the pole, and on the lower surface of the bolt. The tongue 124 preferably fills the space in the oversized hole drilled in the pole, mating with the lower portion of the "L" bolt 110, and the horizontal stake 113, to provide a snug fit which essentially locks the bolt in place.

Next, the guide washer 130 is slid over the bolt, with the tabs 132, 134 facing the pole and the plate 120. The top of the guide washer is the semi-circular portion, while the bottom of the washer has the squared base with corners 137*a,* 137*b* bent toward the plate. The washer tabs 132, 134 abut directly with the plate 120, providing a gap between the plate and the washer. A standard split lockwasher 170, preferably ⅝ inch, and a standard nut 172, preferably a ⅝ inch 10 nut, are next respectively guided over the bolt 110 and threaded into position to secure the bolt in place. A temporary step may now be installed, mounting in the gap formed between the plate 120 and the guide washer 130. Although this embodiment utilizes a nut to secure the support member, in this case a bolt, other fasteners could also be used, or the support member could be fixedly secured such as by welding.

Just as in the previously described pole step embodiment, in this step mount embodiment, the mating of the "L" bolt 110 with the tongue 124 of the plate 120 prevents the bolt 110 from being pulled back out of the pole as the nut 172 is tightened. Without such mating of the bolt 110 with the plate 120, the bolt ends up at a 30–45 degree angle to the horizontal, with the vertical leg 112 of the bolt a corresponding angle away from the inner surface of the wall 195 of the pole. Having the bolt in this position creates undesirable stress concentrations on the fiberglass pole, and it further leaves the bolt susceptible to accidental removal from the pole; in the event of an upward force on the horizontal portion of the bolt, the vertical leg could rotate out of the pole. However, with the locking tongue 124 of the plate 120 described in accordance with a presently preferred embodiment of the invention, the "L" bolt remains substantially horizontal, with only a slight elevation resulting from the tolerances required during manufacturing and installation. Furthermore, because the locking tongue 124 of the plate 120 becomes slightly embedded into the edges of the mounting hole 190, the bolt 110 is kept from rotating while the nut 172 is being tightened.

A third embodiment of the present invention provides another step mount for attaching temporary steps to hollow poles, such as those made of fiberglass, and with a minimal protrusion extending from the pole. These step mounts are mounted permanently to the hollow pole, and temporary steps, or other equipment or accessories, may be attached to the mounts. The protrusion beyond the face of the pole is minimal, preferably approximately ½ inch, making this type of mount useful in areas where unauthorized pole climbing is a problem, because when the temporary steps are removed, the step mounts are too small themselves to provide stepping surfaces for unauthorized climbers.

Figure 7:
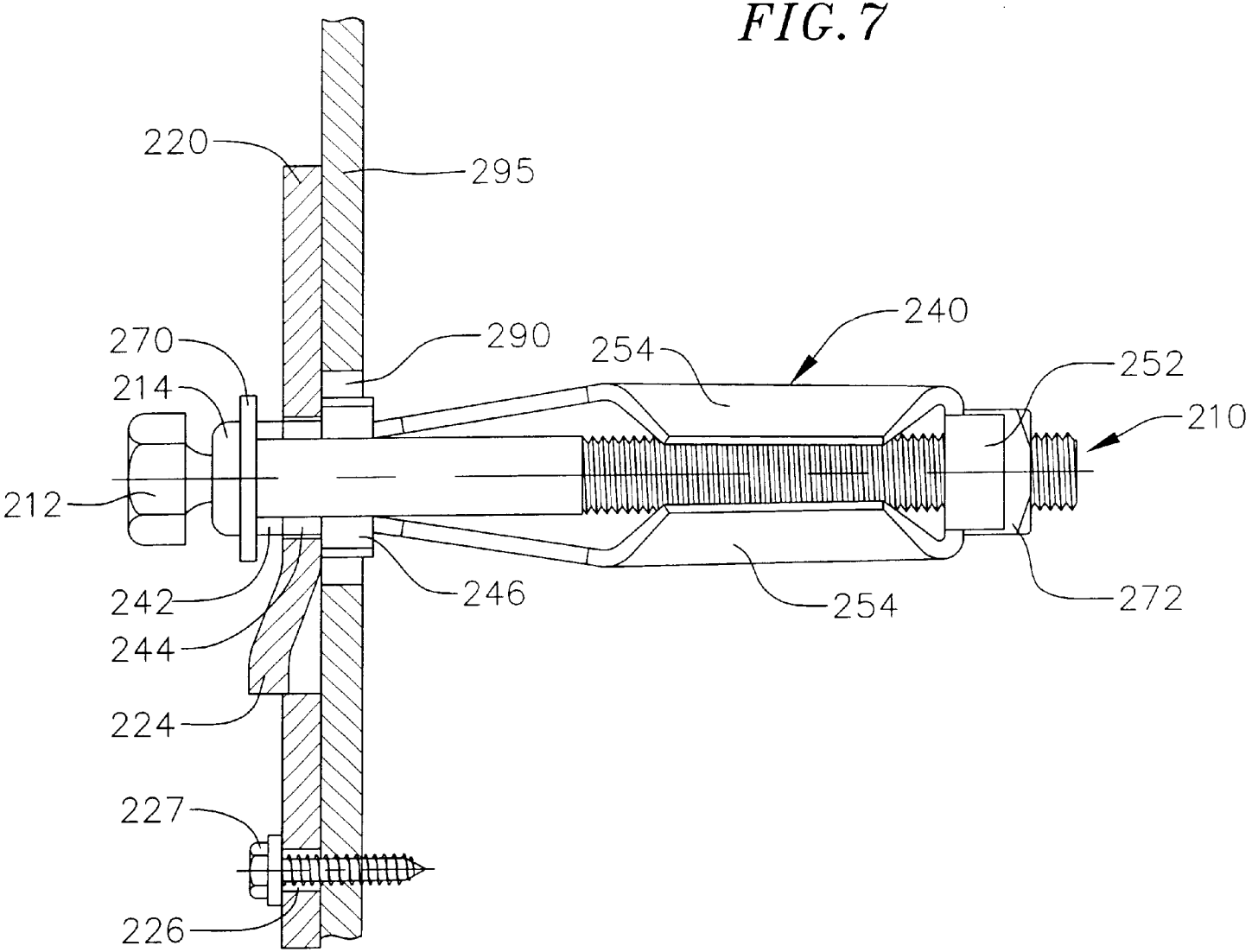
FIG. 7 is a side view of a temporary step mount assembly, including the bolt, plate and collapsible cage, according to a third embodiment of the present invention.

Referring to FIG. 7, in the preferred embodiment, the support member is a bolt 210, preferably a ½"-13 bolt, with a specially designed head 212 that twists off under a predetermined load when the step mount has been fully installed. A screw or other threaded member could also be used as a support member. The twist-off head 212 is hexagonal in shape, and preferably has the standard dimensions of a ½"-13 hex head bolt. The second head 214 of the bolt, which will be what remains after the hex head 212 twists off, is thin and button shaped. In the preferred embodiment, the portion of the bolt between the two heads is machined to a 0.285" diameter so that the twist-off head 214 shears away when the proper installation torque for the mount is applied. Such installation torque in the preferred embodiment ranges between 45 and 55 ft-lbs. In addition to limiting the protrusion from the post, the twist-off head also eliminates over tightening problems, and the accompanying stresses that they may create on the wall 295 of the hollow pole. The twist off head 212 ensures that the assembly, and in particular the plate 220 and the collapsed cage 240, are tightened to the proper torque.

Figure 8:
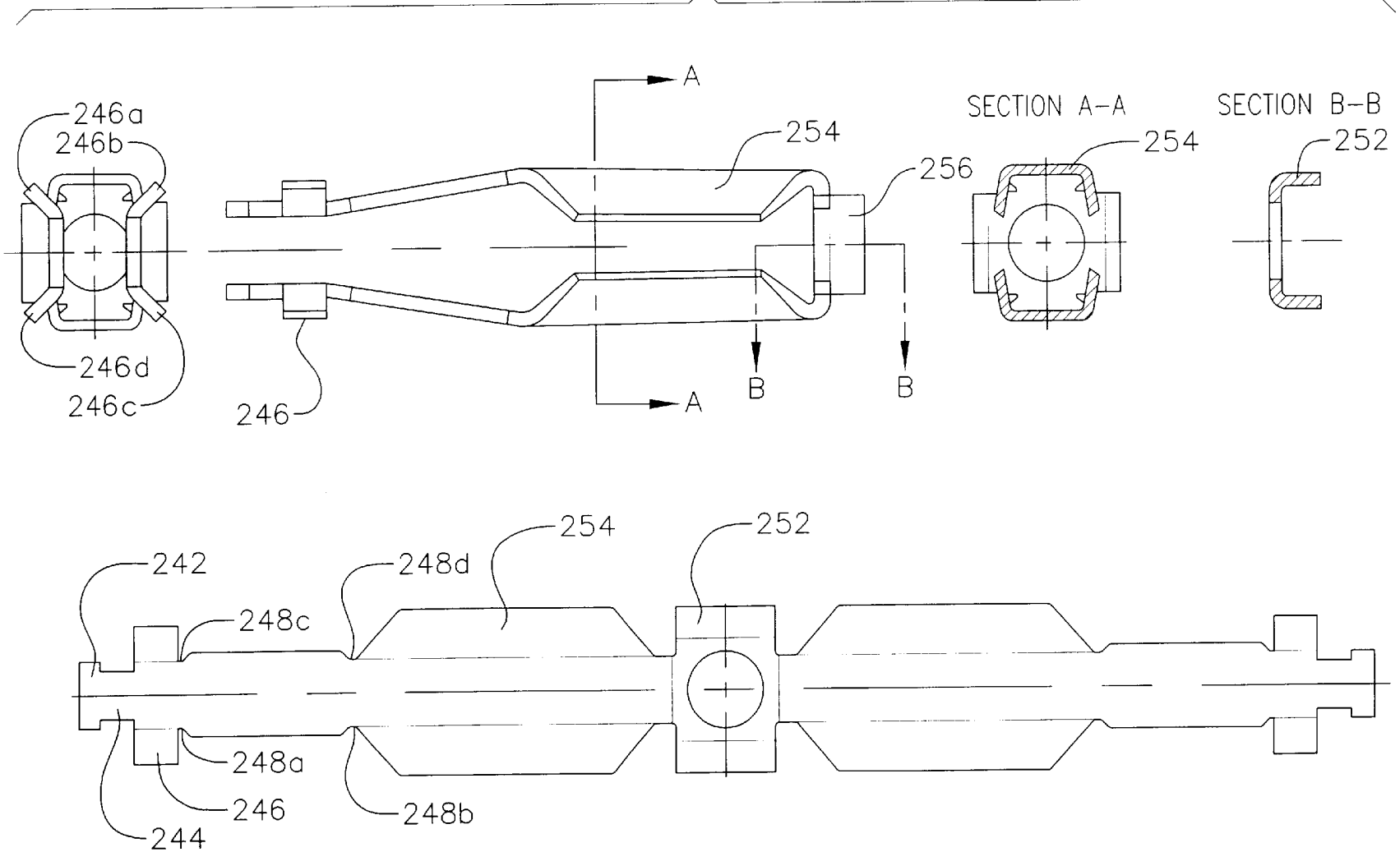
FIG. 8 comprises a side view, views from each end, and an unfolded view of the collapsing cage of FIG. 7.
Figure 10:
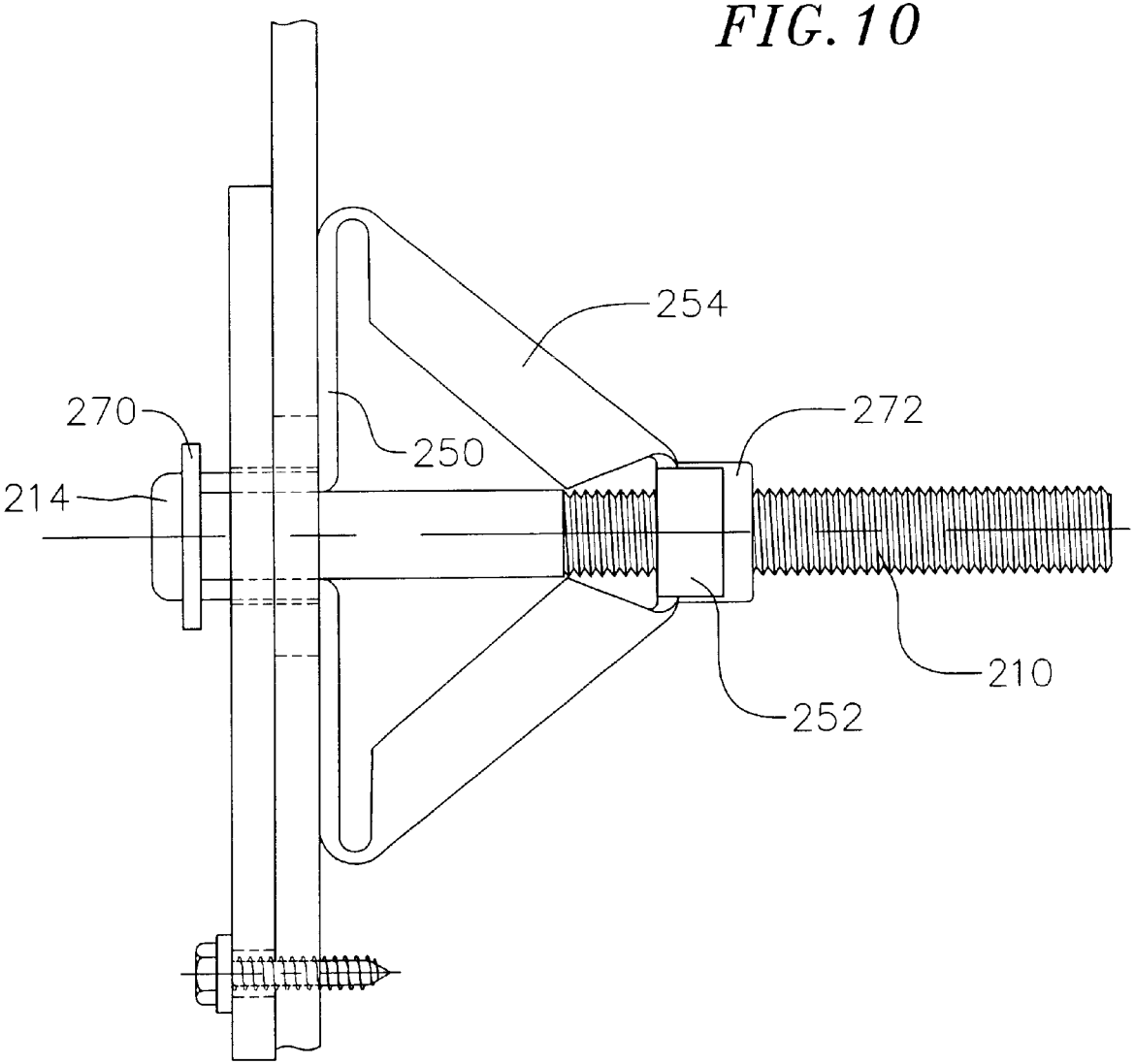
FIG. 10 is a side view of the temporary step mount assembly of FIG. 7 after installation, with the cage collapsed.
Figure 2:
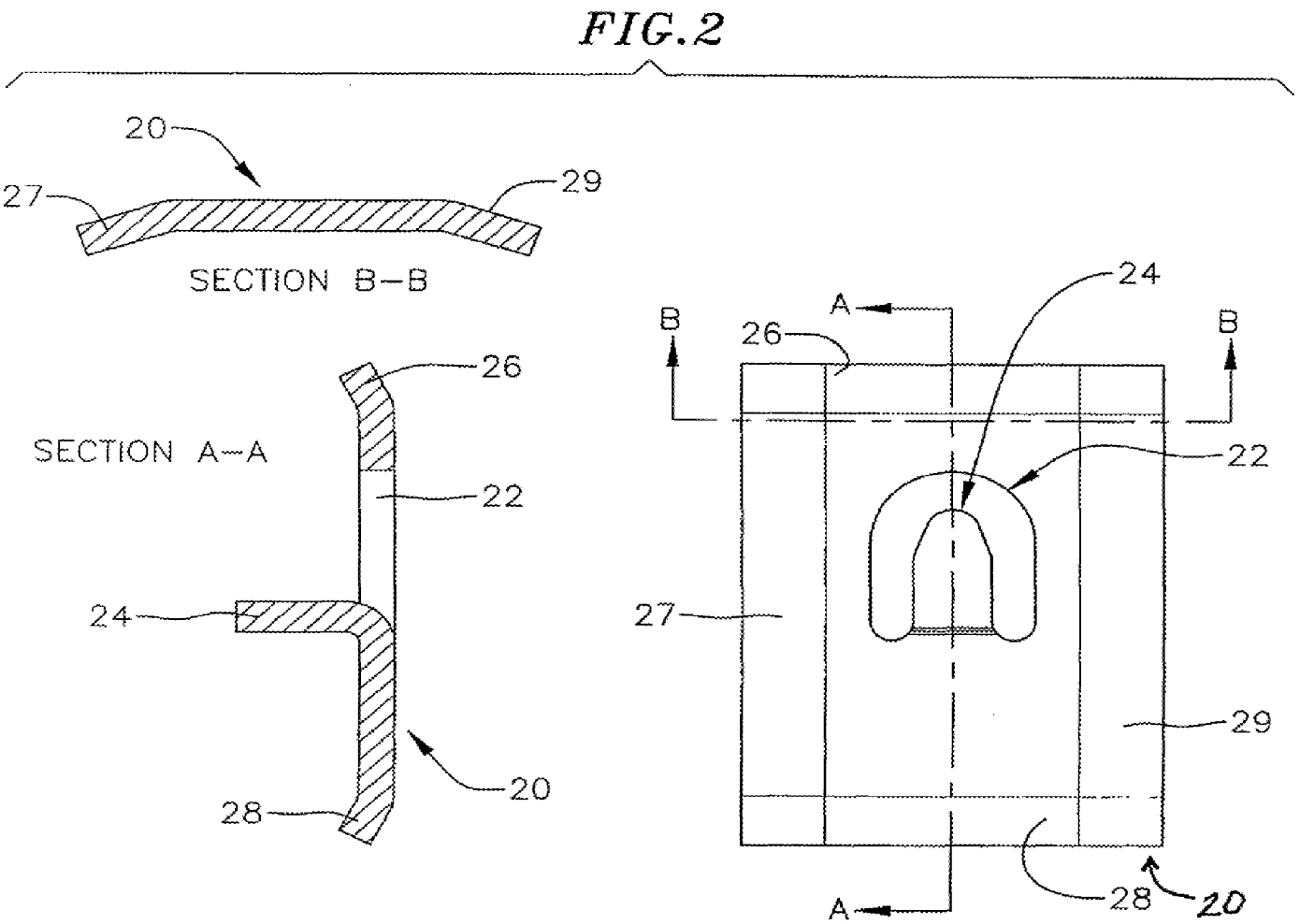
Figure 8:
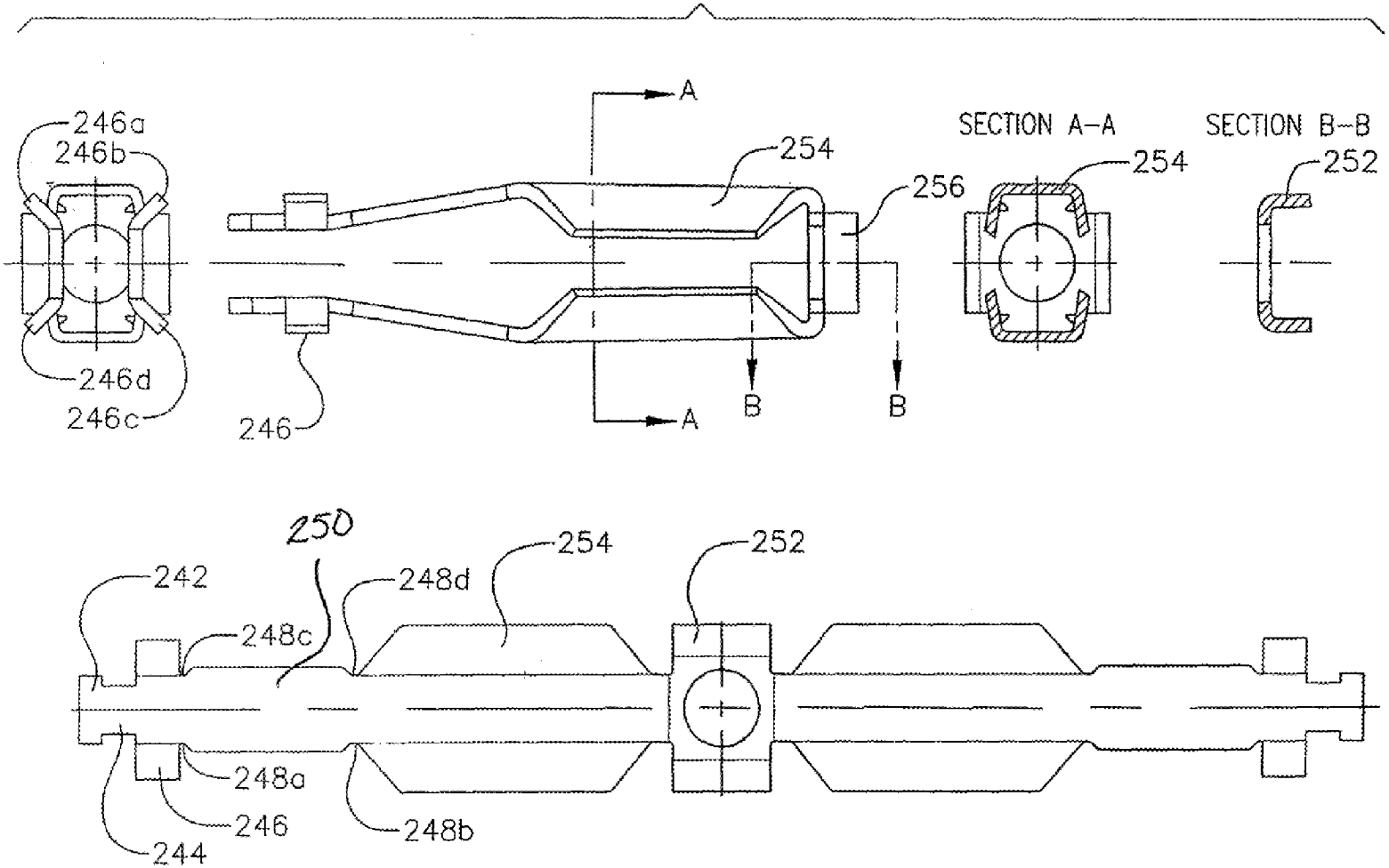

Another component of this embodiment of the invention is a cage 240. Various views of the cage are illustrated in FIG. 8. Preferably, the cage is made of 0.110" thick 304 stainless steel. When installed into the hollow pole, the cage collapses into a truss shape, holding the bolt 210 securely in place inside the pole. FIG. 10 depicts an installed step mount wherein the cage has collapsed to form a truss shape.

Referring to FIGS. 7 and 8, the cage comprises a key 242, preferably 0.180", which forms a gap with the head of the bolt and flatwasher (FIG. 7) to allow a temporary step to be inserted. Next, a second key 244, preferably 0.265", interlocks with a bearing plate 220, preferably 0.250" thick, (discussed below in conjunction with FIG. 9), to hold the pieces together, and prevent rotation of the cage 240 while it is being collapsed. A third key 246, preferably 0.335", is formed into four wings 246*a,b,c,d* with an approximate diameter of 1.375" as illustrated at FIG. 8, to properly position the cage 240 in the hole 290 drilled into the wall 295 of the fiberglass pole. The cage 240 further contains undercuts 248*a,b,c,d* on both sides of a collapsing section 250, preferably 0.625" wide, to ensure that the cage collapses in the correct locations. A central section 254 of the cage, preferably 1.250", is bent almost into a "C" shape to give it the required load carrying capacity. The end section 252 of the cage, also preferably 1.250", is also bent, and acts as an anti-rotation holder for the square nut 272, preferably a ½"-13 square nut, used in the assembly.

Figure 9:
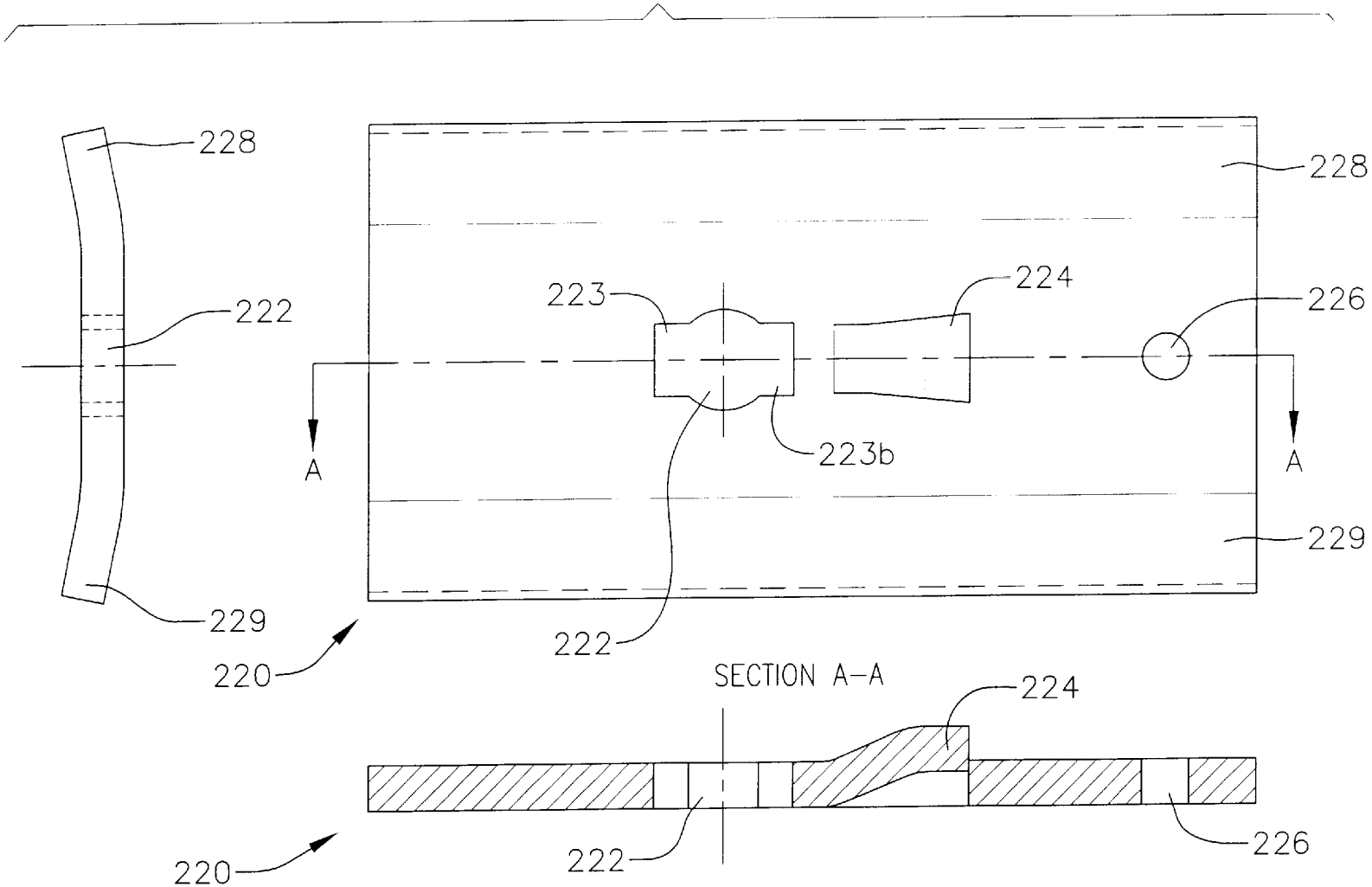
FIG. 9 comprises a top view, frontal view, and cross section view along lines A—A of the plate of FIG. 7.

Another component of this step mount embodiment of the present invention is a bearing plate 220, as illustrated in FIG. 9. In one embodiment of the invention, the plate is made of 0.250" thick mild steel. The plate 220 has a main hole 222, preferably 0.563" diameter, with notches 223*a,b* on the top and bottom of the hole to allow the plate to interlock with and prevent the cage 240 from rotating. A protruding tab 224 on the face of the plate keeps the temporary pole step from rotating about the bolt 210 when it is installed. A smaller hole 226, preferably 0.250" diameter, accommodates a screw 227, preferably a #10 sheet metal screw (FIG. 7), which is used to assist installation and prevent rotation of the plate. The outside edges 228, 229 of the plate 220 are bent inwardly approximately 0.438" to provide a better mating surface to the round pole. The plate also keeps the collapsed cage 240 from pulling through the wall 295 of the fiberglass pole under heavy-loads.

Referring to FIG. 7, to install the temporary pole step mount, the cage 240 is inserted into the plate 220. The cage is inserted into the hole 222 and notches 223*a,* 223*b* of the plate, then rotated to lock it in place relative to the plate. A flatwasher 270, preferably ½" SAE, is inserted onto the bolt 210. Next, the bolt 210 is inserted through the hole 222 in the bearing plate 220, and into the attached cage 240. After the bolt has been inserted into the cage, a square nut 272 is threaded over the end of the bolt and into the end of the cage where the nut is received and held by end section 252 of the cage. The entire assembly, including the bolt 210, washer 270, plate 220, cage 240, and square nut 272, is inserted through a hole 290 in the wall of the pole, preferably 1.375"

in diameter. A screw 227 is driven through the hole 226 in the bearing plate 220, and into the wall 295 of the pole. The screw holds the assembly in place and keeps the plate from rotating when collapsing the cage.

A conventional wrench is next used to turn the hexagon head 212 of the bolt. As the bolt is turned, the cage 240 collapses into a truss inside the pole (see FIG. 10). The key 244 on the cage 240 interlocks with the notches 233*a,* 233*b* on the bearing plate 220 to prevent the cage 240 from rotating as it is being collapsed by the rotation of the bolt. The installation torque need not be monitored since the hexagon head 212 will twist off when the proper torque has been reached. The bolt is turned until the hex head twists off, leaving only the button shaped head 214 of the bolt exposed. Key 242 on the cage provides a gap between the button head 214 of the bolt and the washer 270 on one side, and the plate 220 on the other, where a temporary step may be mounted.

FIG. 10 illustrates the step mount following the complete installation. The collapsing portion 250 of the cage 240 has collapsed, and is parallel to the wall 295 of the pole, forming a truss with the central section 254 of the cage 240. The hex head has been twisted off the bolt, leaving only the button shaped head 214. A small gap is formed between the button shaped head 214 and the flatwasher 270 on one side, and the plate 240 on the other. This gap receives a temporary step. Preferably, the installed step mount protrudes only ½" from the face of the bearing plate. Thus, a pole with this step mount installed helps curtail unauthorized pole climbing since the pole cannot be easily climbed without the attachment of a temporary step.

Although the invention has been described with reference to several specific embodiments with specific preferred dimensions, this description is not meant to be construed in a limiting sense. Various modifications to the dimension of the disclosed embodiment as well as alternative embodiments of the invention will become apparent to one skilled in the art upon reference to the description of the invention. For instance, such steps or step mounts may be utilized in any hollow pole, such as fiberglass poles as in the preferred embodiment, or poles made of steel or concrete. Furthermore, modifications may be made to the size, proportion, measurements and material of any of the various components and parts without departing from the spirit and scope of the invention as defined by the following claims.

What is claimed is:

1. An attachment mount for attaching temporary steps or objects to a wall of a hollow pole, comprising:

a support member having shear-away head at one end and a remaining head adjacent thereto, wherein the support member, shear-away head, and remaining head are integrally formed;

a bearing plate having an aperture receiving the support member therethrough; and a collapsible cage coupled to the support member, the collapsible cage having an extended insertion position and a collapsed supporting position to couple the support member to the hollow pole, wherein the collapsible cage interlocks with the plate to prevent relative rotation therebetween.

2. An apparatus as in claim 1, wherein the bearing plate further defines a tab protruding outward toward the remaining head of the support member, such that the tab prevents rotation of an installed object about the support member or the plate.

3. An apparatus as in claim 1 wherein the bearing plate has a first aperture, for receiving the support member, and a second aperture, for receiving a screw, such that the plate may be coupled to the pole.

4. An apparatus as in claim 1, wherein the collapsible cage has one or more positioning keys, such that its position is axially fixed relative to the bolt.

5. A apparatus as in claim 1, wherein portions of the cage are bent to increase rigidity.

6. An apparatus as in claim 1, wherein the out side edges of the plate are bent inwardly to provide a tight mating surface with the exterior of the hollow pole.

7. An apparatus as in claim 1 wherein the shear-away head of the support member may be twisted off with a predetermined amount of torque, leaving the remaining head at the end of the support member.

8. An apparatus as in claim 1 wherein the support member is threaded.

9. An apparatus as in claim 1 wherein the support member is a bolt.

10. An apparatus as in claim 1 wherein the support member is a screw.

11. An apparatus as in claim 1 wherein the support member is a threaded rod.

12. An apparatus as in claim 1, wherein the collapsible cage is threaded for coupling with the support member.

13. An apparatus as in claim 1, wherein the collapsible cage provides guides to position the cage about an installation hole in the hollow pole.

14. An apparatus as in claim 1, wherein the collapsed supporting position of the collapsible cage defines a truss.

15. An apparatus as in claim 14, wherein the collapsible cage threadedly coupled to the bolt, and has two collapsing members, such that rotation of the bolt in an engaging direction causes the cage to collapse into its truss-shaped supporting position.

16. An apparatus as in claim 14, wherein the truss defined by the collapsible cage is substantially perpendicular to the support member, and substantially parallel to the bearing plate to anchor the support member in place.

17. An apparatus as in claim 14, wherein the collapsible cage has undercut areas to effectuate proper collapse.

18. An apparatus as in claim 14, further comprising a fastener, wherein the collapsible cage is for receiving the fastener, and the fastener is for engaging the support member.

19. An apparatus as in claim 18 wherein the fastener is a nut.

20. An apparatus as in claim 18, wherein the collapsible cage provides a spacing key, such that a gap is provided along the support member between the remaining head and the bearing plate.

21. An apparatus as in claim 20, wherein the object to be attached is a temporary step.

22. An apparatus as in claim 20, wherein the object to be attached is electrical equipment.

23. An apparatus as in claim 20, wherein the object to be attached is telephonic equipment.

24. An apparatus as in claim 20, wherein the object to be attached is pole climbing equipment.

25. An apparatus as in claim 20, wherein the object to be attached is lifting equipment.

26. An apparatus as in claim 20, further comprising a washer abutting the remaining head of the bolt, such that the gap provided to receive a temporary step is located between the washer and the plate.

27. An apparatus for attaching to hollow poles, comprising:

a hollow pole, having a wall and a mounting hole in the wall;

a bolt having shear-away head at one end and a remaining head adjacent thereto wherein the support member, shear-away head, and remaining head are integrally formed;

a bearing plate, having an aperture for receiving the bolt; and a collapsible cage, for threadedly engaging the bolt, the cage having undercut portions for bending under axial pressure, such that the cage may be collapsed into a truss, and having positioning keys maintaining its position relative to the bolt and the plate;

wherein the plate receives the cage, and the cage threadedly couples with the bolt, such that the cage may be inserted into a hollow pole, with the plate and bolt head remaining on the exterior of the pole, and the cage may be collapsed by rotation of the bolt, forming a truss parallel to and abutting the interior wall of the pole.

* * * * *

UNITED STATES PATENT AND TRADEMARK OFFICE

CERTIFICATE OF CORRECTION

PATENT NO. : 6,595,323 B2
APPLICATION NO. : 09/982674
DATED : July 22, 2003
INVENTOR(S) : Lindsey et al.

It is certified that error appears in the above-identified patent and that said Letters Patent is hereby corrected as shown below:

| | |
|---|---|
| Fig 2, Sheet 2 of 10 | Delete Drawing Sheet 2 and substitute therefore the Drawing Sheet, consisting of Fig. 2, as shown on the attached page |
| Fig. 8, Sheet 8 of 10 | Delete Drawing Sheet 8 and substitute therefore the Drawing Sheet, consisting of Fig. 8, as shown on the attached page |
| Claims 3, 7, 8, 9, 10, 11, 19 | Insert --,-- before "wherein" |
| Column 10, Claim 4, line 5 | Before "the bolt", Insert --the plate and-- |
| Column 10, Claim 5, line 6 | Delete "A", Insert --An-- |
| Column 10, Claim 6, line 8 | Delete "out side", Insert --outside-- |
| Column 10, Claim 15, line 31 | After "cage", Insert --is-- |
| Column 11, Claim 27, line 2 | Before "wherein the support member,", Insert --,-- |

Signed and Sealed this

Twenty-first Day of November, 2006

JON W. DUDAS
*Director of the United States Patent and Trademark Office*

B
22
29
20
24
28
A
A
26
B
27
29
26
22
20
SECTION B–B
SECTION A–A
20
28
27
24